US009726995B2

(12) United States Patent
Sakamoto et al.

(10) Patent No.: US 9,726,995 B2
(45) Date of Patent: Aug. 8, 2017

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinya Sakamoto, Kanagawa (JP); Kazuhiko Nakamura, Kanagawa (JP); Masaru Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/017,930

(22) Filed: Feb. 8, 2016

(65) Prior Publication Data

US 2017/0090317 A1 Mar. 30, 2017

(30) Foreign Application Priority Data

Sep. 25, 2015 (JP) ..... 2015-188590

(51) Int. Cl.

| | |
|---|---|
| ***G03G 9/087*** | (2006.01) |
| ***G03G 9/09*** | (2006.01) |
| ***G03G 15/08*** | (2006.01) |
| ***G03G 9/08*** | (2006.01) |

(52) U.S. Cl.

CPC ..... *G03G 9/08755* (2013.01); *G03G 9/0804* (2013.01); *G03G 9/0819* (2013.01); *G03G 9/08795* (2013.01); *G03G 9/0902* (2013.01); *G03G 15/0865* (2013.01)

(58) Field of Classification Search

CPC ..... G03G 9/08755; G03G 9/08795; G03G 9/0902

USPC ..... 430/109.4, 111.4

See application file for complete search history.

(56) References Cited

U.S. PATENT DOCUMENTS

| | | | | |
|---|---|---|---|---|
| 6,773,857 | B2 * | 8/2004 | Nakamura | G03G 5/142 399/159 |
| 2010/0104971 | A1 * | 4/2010 | Yuasa | G03G 9/0804 430/137.14 |
| 2010/0330485 | A1 * | 12/2010 | Pawlak | G03G 9/0815 430/108.4 |
| 2011/0177447 | A1 | 7/2011 | Suzuki et al. | |
| 2013/0137030 | A1 * | 5/2013 | Sato | G03G 9/0819 430/108.11 |
| 2016/0054670 | A1 * | 2/2016 | Urabe | G03G 9/0823 430/105 |

FOREIGN PATENT DOCUMENTS

| | | | |
|---|---|---|---|
| JP | H08219119 | A | 8/1996 |
| JP | H1048886 | A | 2/1998 |
| JP | 2001295170 | A | 10/2001 |
| JP | 2003096170 | A | 4/2003 |
| JP | 2010118370 | A | 5/2010 |
| JP | 2011203704 | A | 10/2011 |
| JP | 2013-057906 | A | 3/2013 |

* cited by examiner

*Primary Examiner* — Janis L Dote
(74) *Attorney, Agent, or Firm* — Oliff PLC

(57) ABSTRACT

A brilliant toner includes toner particles that include a binder resin having a ratio (Mz/Mn) of a Z average molecular weight (Mz) to a number average molecular weight (Mn) of 5 to 20 and a peak top molecular weight (Mp) of 3,000 to 10,000, and a flake-shaped brilliant pigment.

8 Claims, 3 Drawing Sheets

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-188590 filed Sep. 25, 2015.

BACKGROUND

1. Technical Field

The present invention relates to a brilliant toner, an electrostatic charge image developer, and a toner cartridge.

2. Related Art

In recent years, for the purpose of forming an image having brilliance similar to metallic luster, the use of brilliant toners including a brilliant pigment has been examined.

SUMMARY

According to an aspect of the invention, there is provided a brilliant toner including:

toner particles that includes a binder resin having a ratio (Mz/Mn) of a Z average molecular weight (Mz) to a number average molecular weight (Mn) of 5 to 20 and a peak top molecular weight (Mp) of 3,000 to 10,000, and a flake-shaped brilliant pigment.

BRIEF DESCRIPTION OF THE DRAWINGS

Exemplary embodiments of the present invention will be described in detail based on the following figures, wherein.

DETAILED DESCRIPTION

Figure 1:
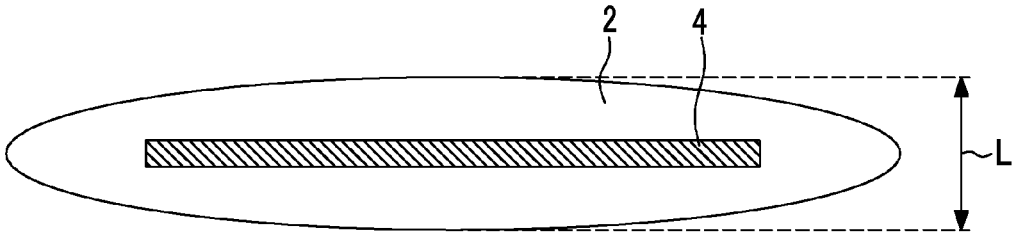
FIG. 1 is a cross-sectional view schematically showing an example of toner particles according to an exemplary embodiment.

Hereinafter, exemplary embodiments as examples of the present invention will be described in detail.

Brilliant Toner

A brilliant toner according to an exemplary embodiment (hereinafter, sometimes referred to as "toner") has toner particles that include a binder resin having a ratio of a Z average molecular weight (hereinafter, also referred to as "Mz") to a number average molecular weight (hereinafter, also referred to as "Mn") (hereinafter, also referred to as "ratio (Mz/Mn)") of 5 to 20 and a peak top molecular weight (hereinafter, also referred to as "Mp") of 3,000 to 10,000, and a flake-shaped brilliant pigment.

With the toner according to the exemplary embodiment having the above configuration, when an image having a low image density (for example, an image density of 5% or less) is continuously formed (for example, an image is continuously formed on 100,000 sheets or more) in a low temperature and low humidity (for example, at a temperature of 10° C. or lower and a humidity of 15% or less) environment, and then an image having a high image density (for example, an image density of 25% or more) is formed in a high temperature and high humidity (for example, at a temperature of 28° C. or higher and a humidity of 85% or more) environment, an image having a high image brilliance may be obtained while a phenomenon that toner scatters from an image portion to a non-image portion (fogging) is prevented. The reason is presumed as follows.

The resin having a ratio (Mz/Mn) of 20 or less has a narrow molecular weight distribution and has a small amount of a component having a molecular weight larger than the number average molecular weight compared to a resin having a ratio (Mz/Mn) of more than 20.

In the preparation of the toner particles, while stirring, pigment particles are incorporated in a melted binder resin or a resin solution in which a binder resin is dissolved in an organic solvent to obtain toner particles through a granulation step. At this time, when a resin having a narrow molecular weight distribution and a small amount of a high molecular weight component (a component having a large molecular weight) is used as the binder resin, the viscosity of the melted binder resin or the resin solution does not become too high and the variation in molecular weight between the obtained toner particles is reduced by stirring.

On the other hand, when a resin having a wide molecular weight distribution and including a large amount of a high molecular weight component is used as the binder resin, the viscosity of the melted binder resin or the resin solution easily becomes high and resin particles having a large amount of a low molecular weight component (a component having a small molecular weight) and resin particles having a large amount of a high molecular weight component are easily formed even with stirring.

Since a strong shearing force is applied to the resin particles having a large amount of a low molecular weight component, the pigment particles are not easily incorporated in the resin particles, and the amount of the pigment particles incorporated is reduced. In contrast, since a shearing force to be applied by stirring is weak, a large number of pigment particles are easily incorporated in the resin particles having a large amount of a high molecular weight component. That is, when a resin having a wide molecular weight distribution and including a large amount of a high molecular weight component is used as the binder resin, the variation in molecular weight between the toner particles increases and the variation in the number of pigment particles incorporated in one toner particle also increases.

In contrast, since the ratio (Mz/Mn) is 20 or less in the exemplary embodiment, the variation in molecular weight between the toner particles is small and the variation in the number of pigment particles incorporated in one toner particle between the toner particles is also small.

Since the brilliant pigment has a high conductivity compared to the binder resin, the charging properties of the toner particles vary depending on the number of pigment particles incorporated in one toner particle. Specifically, toner particles having a large number of pigment particles have low charging properties and toner particles having a small number of pigment particles have high charging properties. Therefore, when the variation in the number of pigment particles between the toner particles is large, the variation in charging properties between the toner particles is also large and the charging distribution is wide.

However, since the variation in the number of pigment particles between the toner particles is small in the exemplary embodiment, the variation in charging properties between the toner particles is small and the charging distribution is narrow. Therefore, in a process of forming an image having a high image density in a high temperature and high humidity environment, a phenomenon that toner scatters from an image portion to a non-image portion (hereinafter, also referred to as "fogging") is prevented. Specifically, when the charging distribution is wide, the electrostatic attraction of toner particles having relatively low charging properties is weak and thus the aggregation of the particles caused by the electrostatic attraction is reduced, which easily causes the aforementioned fogging. However, since the charging distribution is narrow in the exemplary embodiment, the aforementioned fogging is prevented.

In the exemplary embodiment, the ratio (Mz/Mn) is from 5 to 20, and Mp is from 3,000 to 10,000. Therefore, compared to a case in which the ratio (Mz/Mn) is less than 5, the amount of a component having a molecular weight smaller than the number average molecular weight is small. Compared to a case in which Mp is less than 3,000, the amount of a low molecular weight component having a molecular weight of less than 3,000 is small.

When toner particles having a small amount of a low molecular weight component are strong to a mechanical load compared to the toner particles having a large amount of a low molecular weight component, toner particles from which the pigment is exposed are not easily formed irrespective of application of a load by stirring in a developing device for a long period of time by continuously forming an image having a low image density in a low temperature and low humidity environment.

As described above, since the brilliant pigment has a high conductivity compared to the binder resin, the charging properties of toner particles from which the pigment is exposed are remarkably deteriorated and in a process of forming an image having a high image density in a high temperature and high humidity environment, the aforementioned fogging easily occurs.

However, as described above, in the exemplary embodiment, since the toner particles from which the pigment is exposed are not easily formed, even when an image having a low image density is continuously formed in a low temperature and low humidity environment and then an image having a high image density is formed in a high temperature and high humidity environment, the aforementioned fogging is prevented.

In the exemplary embodiment, since the ratio (Mz/Mn) is from 5 to 20 and the Mp is from 3,000 to 10,000, compared to a case in which the Mp is more than 10,000, the binder resin of the toner particles is easily melted at the time of fixing. Therefore, even when an image having a high image density is formed, the brilliant pigment is easily aligned in a state of being almost parallel with a recording medium at the time of fixing and high image brilliance is easily obtained.

From the above, it is presumed that due to the above configuration of the toner according to the exemplary embodiment, when an image having a low image density is continuously formed in a low temperature and low humidity environment and then an image having a high image density is formed in a high temperature and high humidity environment, an image in which high image brilliance is attained and a phenomenon that toner scatters from an image portion to a non-image portion (fogging) is prevented may be obtained.

The Mz, Mn, and Mp of the binder resin are measured by gel permeation chromatography (GPC). The molecular weight measurement by GPC is performed by using GPC•HLC-8120GPC manufactured by Tosoh Corporation as a measuring device, TSKgel SuperHM-MH (6.0 mm ID×15 cm) manufactured by Tosoh Corporation, as a column, and a tetrahydrofuran (THF) solvent. Specifically, a solution obtained by dissolving the toner in the solvent (tetrahydrofuran) by mixing the toner and the solvent and removing a component insoluble in the solvent is used as a measurement sample. Other measurement conditions are as follows: the sample concentration: 0.5% by weight, the column temperature: 40° C., the amount of the measurement sample injected: 10 μl, the flow rate of the measurement sample: 0.6 ml/min, and a detector: an RI detector. The Mz, Mn, and Mp are calculated using a calibration curve of molecular weight created with a monodisperse polystyrene standard sample from the measurement results obtained from the measurement. The calibration curve of molecular weight is created with ten "polystyrene standard samples of TSK Standards": "A-500", "F-1", "F-10", "F-80", "F-380", "A-2500", "F-4", "F-40", "F-128", and "F-700" (manufactured by Tosoh Corporation).

When the binder resin includes plural resins, the Mz, Mn, and Mp of the binder resin are Mz, Mn, and Mp that are calculated from the molecular weight distribution of the total of the plural resins.

The Mp of the binder resin is from 3,000 to 10,000, preferably from 4,000 to 8,000, more preferably from 4,500 to 8,000, and still more preferably 5,500 to 7,000.

The ratio (Mz/Mn) of the binder resin is from 5 to 20, preferably from 7 to 13, and more preferably from 8.5 to 11.5.

The Mz of the binder resin is not particularly limited as long as the ratio (Mz/Mn) is in the above range. For example, the Mz of the binder resin is from 22,000 to 46,000 and preferably from 28,000 to 40,000.

The Mn of the binder resin is not particularly limited as long as the ratio (Mz/Mn) is in the above range. For example, the Mn of the binder resin is from 2,000 to 5,000 and preferably from 3,000 to 4,000.

As a method of controlling the ratio (Mz/Mn) and Mp of the binder resin to be in the above ranges, for examples, methods of adjusting the addition amounts of monomers, additives, solvents, and the like used for synthesis of resin, and synthesis conditions (temperature, time and the like) and the like may be used.

Particularly, when the binder resin includes "a urea-modified polyester resin obtained by reaction between a polyester prepolymer having isocyanate groups and an amine compound", which will be described later, for example, the ratio (Mw/Mp) and Mp of the binder resin may be controlled by adjusting a mixing ratio between the urea-modified polyester resin and another resin, adjusting the ratio between the isocyanate group of the polyester prepolymer and the amine group of the amine compound used for the synthesis of the urea-modified polyester resin, and adjusting the Mw and the Mp of the polyester prepolymer.

Here, the "brilliance" in the toner according to the exemplary embodiment indicates that an image has brilliance similar to metallic luster when the image formed by the brilliant toner is visually checked.

Specifically, when a solid image is formed using the toner according to the exemplary embodiment, it is preferable that a ratio (X/Y) between a reflectance X at a light receiving angle of +30° measured when the image is irradiated with incident light at an incident angle of −45° by a goniophotometer and a reflectance Y at a light receiving angle of −30° is from 2 to 100.

If the ratio (X/Y) is equal to or greater than 2, this indicates that light is reflected more toward a side ("angle+"

side) opposite to the light incident side than toward a side ("angle−" side) where the incident light enters, that is, this indicates that diffuse reflection of the incident light is prevented. When the diffuse reflection in which the incident light is reflected to various directions is caused, if the reflected light is visually checked, colors look blurry. Therefore, when the ratio (X/Y) is less than 2, even if the reflected light is visually checked, luster is not confirmed, thereby causing inferior brilliant properties in some cases.

On the other hand, when the ratio (X/Y) exceeds 100, a viewing angle in which the reflected light may be visually checked is narrowed too much, and specular reflected light components are large. Therefore, a phenomenon in which colors look darkish depending on angles may occur. In addition, it is also difficult to prepare a toner in which the ratio (X/Y) exceeds 100.

The ratio (X/Y) is more preferably from 4 to 50, still more preferably from 6 to 20, and particularly preferably from 8 to 15 from the viewpoint of brilliance and toner producibility.

Measurement of Ratio (X/Y) by Goniophotometer

Here, first, an incident angle and a light receiving angle will be described. In the exemplary embodiment, when the measurement is performed by a goniophotometer, an incident angle is set to −45°. This is because the measuring sensitivity to an image having a wide gloss level is high.

In addition, the reason why the light receiving angles are set to −30° and +30° is that the measuring sensitivity for determining an image with brilliance and an image without brilliance is highest.

Next, the measuring method of the ratio (X/Y) will be described.

An image to be measured (brilliance image) is irradiated with incident light at an incident angle of −45° with respect to the image using a spectro-goniophotometer GC 5000 L manufactured by Nippon Denshoku Industries Co., Ltd. as a goniophotometer, and a reflectance X at a light receiving angle of +30° and a reflectance Y at a light receiving angle of −30° are measured. In addition, the reflectance X and the reflectance Y are respectively obtained by performing measurement with light in a wavelength range of 400 nm to 700 nm at intervals of 20 nm and calculating the average value of reflectances of the respective wavelengths. The ratio (X/Y) is calculated from the measurement results.

From the viewpoint of satisfying the ratio (X/Y) described above, the toner according to the exemplary embodiment may preferably meet the requirements (1) and (2) below.

(1) The toner particle has an average equivalent circle diameter D larger than an average maximum thickness C.

(2) When a cross section of the toner particle in a thickness direction thereof is observed, the number of pigment particles arranged so that an angle formed by a long axis direction of the toner particle in the cross section and a long axis direction of a brilliant pigment particle is in a range of −30° to +30° is equal to or greater than 60% of the total number of brilliant pigment particles observed.

When the toner particles have a flake shape in which the equivalent circle diameter is longer than the thickness (refer to FIG. 1), it is considered that the flake-shaped toner particle is arranged such that the flake surface side of the toner particle faces a surface of a recording medium by the pressure at the time of fixing in a fixing step for image formation. In FIG. 1, the reference numeral 2 represents a toner particle, the reference numeral 4 represents a brilliant pigment, and the reference symbol L represents the thickness of the toner particle.

Accordingly, among the flake-shaped brilliant pigment particles contained in the toner particle, brilliant pigment particles that satisfy the requirement "an angle formed by a long axis direction of the toner particle in the cross section and a long axis direction of a brilliant pigment is in a range of −30° to +30°" described in (2) above are considered to be arranged such that the surface side, which provides the maximum area, faces the surface of the recording medium. When an image formed in this manner is irradiated with light, it is considered that the proportion of the brilliant pigment particles, which cause diffuse reflection of incident light, is reduced and thus the above-described range of the ratio (X/Y) may be achieved.

Hereinafter, the toner according to the exemplary embodiment will be described in detail.

The toner according to the exemplary embodiment includes toner particles. The toner may include an external additive which is externally added to the toner particles, if necessary.

Toner Particles

The toner particles include a binder resin and a flake-shaped brilliant pigment. The toner particles may include a release agent and other additives, if necessary.

Binder Resin

Examples of the binder resin include a homopolymer consisting of monomers such as styrenes (for example, styrene, para-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin also include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These binder resins may be used alone or in combination with two or more kinds thereof.

As the binder resin, a polyester resin is suitable.

As the polyester resin, a well-known amorphous polyester resin is used, for example. As the polyester resin, a crystalline polyester resin may be used in combination together with an amorphous polyester resin. However, the crystalline polyester resin may be used at a content of from 2% by weight to 40% by weight (preferably from 2% by weight to 20% by weight) with respect to the total binder resin.

If the toner particles include a polyester resin as the binder resin, an image in which higher image brilliance is attained and a phenomenon that the toner scatters from the image portion to a non-image portion (fogging) is further prevented may be obtained when an image having a low image density is continuously formed in a low temperature and low humidity environment and then an image having a high image density is formed in a high temperature and high humidity environment. The reason is presumed as follows.

Specifically, ester bonds in the polyester resin easily form hydrogen bonds, and the cohesive force between the toner particles is increased. Thus, the toner does not easily scatter. In addition, since the polyester resin as the binder resin easily melts at the fixing temperature, a fixed image in which the brilliant pigment is aligned in a state of being almost parallel with a recording medium is easily obtained and high image brilliance is obtained.

If the toner particles include a crystalline polyester resin as the binder resin, an image in which a phenomenon that the toner scatters from the image portion to a non-image portion (fogging) is further prevented may be obtained when an image having a low image density is continuously formed in a low temperature and low humidity environment and then an image having a high image density is formed in a high temperature and high humidity environment. The reason is presumed as follows.

Specifically, in the case of toner particles obtained by dissolving a binder resin in an organic solvent and granulating the resin solution, if the binder resin includes a crystalline polyester resin, the viscosity of the resin solution in which the binder resin is dissolved in the organic solvent is decreased and a shearing force by stirring at the time of granulation is almost uniformly applied. Therefore, the brilliant pigment particles are almost uniformly incorporated by the resin solution and the difference in charge amount between the toner particles is reduced. Thus, fogging is prevented.

The term "crystalline" resin indicates that the resin does not exhibit a stepwise change in endothermic quantity but has a clear endothermic peak in differential scanning calorimetry (DSC), and specifically, the "crystalline" resin indicates that the half-value width of an endothermic peak when measured at a temperature rising rate of 10° C./min is within 10° C.

On the other hand, the "amorphous" resin indicates that the half-value width is greater than 10° C., a stepwise change in endothermic quantity is exhibited, or a clear endothermic peak is not recognized.

Amorphous Polyester Resin

Examples of the amorphous polyester resin include polycondensates of polyvalent carboxylic acids and polyols. A commercially available product or a synthesized product may be used as the amorphous polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, bisphenol A ethylene oxide adduct and bisphenol A propylene oxide adduct). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Starting Temperature of Glass Transition" disclosed in a method of determining a glass transition temperature of JIS K 7121-1987 "Testing Methods for Transition Temperature of Plastics".

The weight average molecular weight Mw of amorphous polyester resin is preferably from 4,000 to 20,000 and more preferably from 6,000 to 15,000.

The peak top molecular weight Mp of the amorphous polyester resin is preferably from 3,000 to 7,000 and more preferably from 4,000 to 6,000.

The number average molecular weight Mn of the amorphous polyester resin is preferably from 2,000 to 5,000 and more is preferably from 2,500 to 4,000.

The Z average molecular weight Mz of the amorphous polyester resin is preferably from 20,000 to 50,000 and more preferably from 30,000 to 40,000.

A known preparing method is applied to prepare the amorphous polyester resin. Specific examples thereof include a method of conducting a reaction at a polymerization temperature set to 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline Polyester Resin

Examples of the crystalline polyester resin include polycondensates of polyvalent carboxylic acids and polyols. A commercially available product or a synthesized product may be used as the crystalline polyester resin.

Here, as the crystalline polyester resin, in order to easily form a crystal structure, a polycondensate using a polymerizable monomer having a linear aliphatic group is preferably used rather than a polymerizable monomer having an aromatic group.

Examples of the polyvalent carboxylic acid include aliphatic dicarboxylic acids (for example, oxalic acid, succinic acid, glutaric acid, adipic acid, suberic acid, azelaic acid, sebacic acid, 1,9-nonanedicarboxylic acid, 1,10-decanedicarboxylic acid, 1, 12-dodecanedicarboxylic acid, 1,14-tetradecanedicarboxylic acid, and 1,18-octadecanedicarboxylic acid), aromatic dicarboxylic acids (for example, dibasic acids such as phthalic acid, isophthalic acid, terephthalic acid, naphthalene-2,6-dicarboxylic acid), anhydrides thereof, or lower alkyl esters (having, for example, from 1 to 5 carbon atoms) thereof.

As the polyvalent carboxylic acid, a tri- or higher-valent carboxylic acid having a crosslinked structure or a branched structure may be used in combination together with a dicarboxylic acid. Examples of the trivalent carboxylic acid include aromatic carboxylic acids (for example, 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used alone or in combination of two or more kinds thereof.

Examples of the polyol include aliphatic diols (for example, linear aliphatic dials having from 7 to 20 carbon atoms in a main chain portion). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable as the aliphatic diol.

As the polyol, a tri- or higher-valent polyol having a crosslinked structure or a branched structure may be used in combination together with a diol. Examples of the tri- or higher-valent polyol include glycerin, trimethylolethane, trimethylolpropane, and pentaerythritol.

The polyols may be used alone or in combination of two or more kinds thereof.

Here, in the polyol, the content of the aliphatic diol may be 80% by mole or more, and is preferably 90% by mole or more.

The melting temperature of the crystalline polyester resin is preferably from 50° C. to 100° C., more preferably from 55° C. to 90° C., and still more preferably from 60° C. to 85° C.

The melting temperature is obtained from "melting peak temperature" described in the method of obtaining a melting temperature in JIS K 7121-1987 "testing methods for transition temperatures of plastics", from a DSC curve obtained by differential scanning calorimetry (DSC).

The weight average molecular weight Mw of the crystalline polyester resin is preferably from 15,000 to 40,000 and more preferably from 20,000 to 30,000.

The peak top molecular weight Mp of the crystalline polyester resin is preferably from 15,000 to 40,000 and more preferably from 20,000 to 30,000.

The number average molecular weight Mn of the crystalline polyester resin is preferably from 3,000 to 20,000 and more preferably from 5,000 to 15,000.

The Z average molecular weight Mz of the crystalline polyester resin is preferably from 25,000 to 60,000 and more preferably from 35,000 to 50,000.

A known preparing method is applied to prepare the crystalline polyester resin as in the case of the amorphous polyester resin.

Here, examples of the polyester resin also include modified polyester resins other than the aforementioned unmodified polyester resin. The modified polyester resin includes a polyester resin in which bonding groups other than an ester bond are present, and a polyester resin in which resin components different from a polyester resin component are bonded by a covalent bond, an ionic bond and the like. Examples of the modified polyester resin include resins in which the end is modified by reaction of a polyester resin into which a functional group such as an isocyanate group reacting with an acid group or a hydroxyl group at the end thereof is introduced, with an active hydrogen compound.

As the modified polyester resin, a urea-modified polyester resin is particularly preferable. By using a resin including a urea-modified polyester resin and having the ratio (Mz/Mn) and the Mp respectively in the above ranges as the binder resin, an image in which higher image brilliance is attained and a phenomenon that the toner scatters from the image portion to a non-image portion (fogging) is further prevented may be obtained when an image having a low image density is continuously formed in a low temperature and low humidity environment and then an image having a high image density is formed in a high temperature and high humidity environment. This is because when an image having a low image density is continuously formed, an impact generated by the collision between the toner particles or the collision of the toner with a carrier is applied to the tip end of the brilliant pigment in the toner particles, and the brilliant pigment is exposed in some cases. However, it is considered that when the toner includes the urea-modified polyester resin, due to the elastic component derived from the urea-modified polyester resin, the impact is dispsersed from the tip end of the brilliant pigment and the pigment is prevented from being exposed. From this viewpoint, the content of the urea-modified polyester resin is preferably from 5% by weight to 50% by weight and more preferably from 8% by weight to 30% by weight with respect to the total binder resin.

The urea-modified polyester resin may be a urea-modified polyester resin obtained by reaction (at least one of a crosslinking reaction and an elongation reaction) between a polyester resin having isocyanate groups (polyester prepolymer) and an amine compound. The urea-modified polyester resin may contain a urethane bond together with a urea bond.

As the polyester prepolymer having isocyanate groups, a prepolymer obtained by reacting a polyester which is a polycondensate of a polyvalent carboxylic acid and a polyol and has active hydrogen with a polyisocyanate compound may be used. Examples of an active hydrogen containing group of the polyester include hydroxyl groups (alcoholic hydroxyl group and phenolic hydroxyl group), an amino group, a carboxyl group, and a mercapto group. The alcoholic hydroxyl group is preferable.

In the polyester prepolymer having isocyanate groups, the polyvalent carboxylic acid and the polyol are compounds are similar to the above examples of the polyvalent carboxylic acid and the polyol mentioned in the description of the polyester resin.

Examples of the polyisocyanate compound include aliphatic polyvalent isocyanates (such as tetramethylene diisocyanate, hexamethylene diisocyanate, and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as $\alpha,\alpha,\alpha',\alpha'$-tetramethylxylylene diisocyanate); isocyanurates; and compounds formed by blocking the above polyisocyanates with a phenol derivative, oxime, caprolactam, or the like with a blocking agent.

These polyisocyanate compounds may be used alone or in combination of two or more kinds thereof.

The ratio of the polyisocyanate compound is, in terms of an equivalent ratio [NCO]/[OH] between the isocyanate group [NCO] and the hydroxyl group [OH] of the hydroxyl-containing polyester prepolymer, preferably from 1/1 to 5/1, more preferably from 1.2/1 to 4/1, and still more preferably from 1.5/1 to 2.5/1. When the ratio [NCO]/[OH] is from 1/1 to 5/1, the brilliant pigment is prevented from being exposed and fogging caused by deterioration of the charging properties of the brilliant toner is easily prevented. When the ratio [NCO]/[OH] is 5/1 or less, deterioration of the low temperature fixability is easily prevented.

The content of a component derived from the polyisocyanate compound in the polyester prepolymer having isocyanate groups is preferably from 0.5% by weight to 40% by weight, more preferably from 1% by weight to 30% by weight, and still more preferably from 2% by weight to 20% by weight with respect to the total polyester prepolymer having isocyanate groups. When the content of the component derived from the polyisocyanate compound is from 0.5% by weight to 40% by weight, the brilliant pigment is prevented from being exposed and fogging caused by deterioration of the charging properties of the brilliant toner is easily prevented. When the content of the component derived from the polyisocyanate compound is 40% by weight or less, deterioration of the low temperature fixability is easily prevented.

The average number of isocyanate groups contained per molecule of the polyester prepolymer having isocyanate groups is preferably from 1 or more, more preferably from 1.5 to 3, and still more preferably from 1.8 to 2.5. When the number of isocyanate groups per molecule is 1 or more, the molecular weight of the urea-modified polyester resin after reaction increases, and the brilliant pigment is prevented from being exposed. Thus, fogging caused by deterioration of the charging properties of the brilliant toner is easily prevented.

Examples of the amine compound reacting with the polyester prepolymer having isocyanate groups include diamines, tri- or higher-valent polyamines, amino alcohols, amino mercaptans, amino acids, and compounds obtained by blocking these amine groups.

Examples of the diamines include aromatic diamines (such as phenylenediamine, diethyltoluenediamine, and 4,4'-diaminodiphenylmethane), alicyclic diamines (such as 4,4'-diamino-3,3'-dimethyldicyclohexylmethane, diaminecyclohexane, and isophoronediamine); and aliphatic diamines (such as ethylenediamine, tetramethylenediamine, and hexamethylenediamine).

Examples of the tri- or higher-valent polyamines include diethylenetriamine and triethylenetetramine.

Examples of amino alcohols include ethanolamine and hydroxyethyl aniline.

Examples of the amino mercaptans include aminoethyl mercaptan and aminopropyl mercaptan.

Examples of the amino acids include aminopropionic acid and aminocaproic acid.

Examples of the compounds obtained by blocking these amine groups include ketimine compounds obtained from amine compounds, such as diamines, tri- or higher-valent polyamines, amino alcohols, amino mercaptans, and amino acids, and ketone compounds (such as acetone, methyl ethyl ketone, and methyl isobutyl ketone) and oxazoline compounds.

Among these amine compounds, the ketimine compounds are preferable.

These amine compounds may be used alone or in combination of two or more kinds thereof.

The molecular weight of the urea-modified polyester resin after completion of the reaction may be adjusted by adjusting reaction between the polyester resin having isocyanate groups (polyester prepolymer) and the amine compound (at least one of a crosslinking reaction and an elongation reaction) with a reaction terminator which terminates at least one of a crosslinking reaction and an elongation reaction (hereinafter, also referred to as "crosslinking/elongation reaction terminator").

Examples of the crosslinking/elongation reaction terminator include monoamines (such as diethylamine, dibutylamine, butylamine, and laurylamine) and blocked compounds thereof (ketimine compounds).

The ratio of the amine compound is, in terms of an equivalent ratio [NCO]/[NHx] between the isocyanate group [NCO] in the polyester prepolymer having isocyanate groups and the amino group [NHx] in the amines, preferably from 1/2 to 2/1, more preferably from 1/1.5 to 1.5/1, and still more preferably from 1/1.2 to 1.2/1. When the [NCO]/[NHx] is in the above range, the molecular weight of the urea-modified polyester resin after reaction increases, the brilliant pigment is prevented from being exposed, and thus fogging caused by deterioration of the charging properties of the brilliant toner is easily prevented.

The glass transition temperature of the urea-modified polyester resin is preferably from 40° C. to 65° C. and more preferably from 45° C. to 60° C. The number average molecular weight thereof is preferably from 2,500 to 50,000 and more preferably from 2,500 to 30,000. The weight average molecular weight is preferably from 10,000 to 500,000 and more preferably from 30,000 to 100,000.

For example, the content of the binder resin is from 40% by weight to 95% by weight, more preferably from 50% by weight to 90% by weigh, and still more preferably from 60% by weight to 85% by weight with respect to the total toner particles.

Brilliant Pigment

As the brilliant pigment, for example, a pigment (brilliant pigment) that may provide brilliance similar to metallic luster may be used. Specific examples of the brilliant pigment include metal powders such as aluminum (Al element metal), brass, bronze, nickel, stainless steel, and zinc powders; coated foil-shaped inorganic crystalline substrates, such as mica, barium sulfate, layered silicate and layered aluminum silicate coated with titanium oxide or yellow iron oxide; single-crystal planar titanium oxide; basic carbonates; acid bismuth oxychloride; natural guanine; foil-shaped glass powder; and metal-deposited foil-shaped glass powder. The brilliant pigment is not particularly limited as long as the pigment has brilliance.

Among the brilliant pigments, from the viewpoint of mirror surface reflection intensity, metal powders are preferable and among these, aluminum is most preferable.

The brilliant pigment has a flake shape.

The average length of the brilliant pigment in a long axis direction is preferably from 1 μm to 30 μm, more preferably from 3 μm to 20 μm, and still more preferably from 5 μm to 15 μm.

The ratio (aspect ratio) of the average length in the long axis direction when the average length of the brilliant pigment in a thickness direction is 1, is preferably from 5 to 200, more preferably from 10 to 100, and still more preferably 30 to 70.

The respective average lengths and the aspect ratio of the brilliant pigment are measured by the following method. A photograph of the pigment particles is captured by using a scanning electron microscope (S-4800, manufactured by Hitachi High Technologies Co., Ltd.), with measurable magnification power (from 300 times to 100,000 times), the length of each particle in the long axis direction and the length thereof in a thickness direction are measured in a two-dimensional state of the obtained image of the pigment particle, and the average length in the long axis direction and the aspect ratio of the brilliant pigment are calculated.

The content of the brilliant pigment is preferably from 1 part by weight to 50 parts by weight and more preferably from 15 parts by weight to 25 parts by weight, with respect to 100 parts by weight of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the total toner particles.

Other Additives

Examples of other additives include known additives such as a magnetic material, a charge-controlling agent, an inorganic powder and coloring agents other than the brilliant pigment. The toner particles include these additives as internal additives.

Examples of the charge-controlling agent include quaternary ammonium salt compounds, nigrosine compounds, dyes containing a complex of aluminum, iron, chromium, or the like, and triphenylmethane pigments.

Examples of the inorganic particles include known inorganic particles such as silica particles, titanium oxide particles, alumina particles, cerium oxide particles, and particles obtained by hydrophobizing the surfaces of these particles. These inorganic particles may be used alone or in combinations of two or more kinds thereof. Among these inorganic particles, silica particles, which have a refractive index lower than that of the above-described binder resin, are preferably used. The silica particles may be subjected to various surface treatments. For example, silica particles surface-treated with a silane coupling agent, a titanium coupling agent, silicone oil, or the like are preferably used.

Examples of coloring agents other than the brilliant pigment include known coloring agents and the coloring agent is selected according to a target color. As the coloring agents, if necessary, a surface-treated coloring agent may be used or the coloring agent may be used in combination together with a dispersant.

Characteristics of Toner Particles

The toner particles may be toner particles having a single layer structure, or toner particles having a so-called core/shell structure composed of a core (core particle) and a coating layer (shell layer) coated on the core.

The toner particles having a core/shell structure may be composed of, for example, a core containing a binder resin, a brilliant pigment, and if necessary, other additives such as a release agent, and a coating layer containing a binder resin.

Average Maximum Thickness C and Average Equivalent Circle Diameter D of Toner Particles The toner particles have a flake shape and the average equivalent circle diameter D is preferably longer than the average maximum thickness C. In addition, the ratio (C/D) of the average maximum thickness C to the average equivalent circle diameter D is more preferably in a range of 0.001 to 0.500, still more preferably in a range of 0.010 to 0.200, and particularly preferably in a range of 0.050 to 0.100.

When the ratio (C/D) is 0.001 or more, toner strength is more sufficient and fracturing that is caused by a stress in the image formation is prevented, and thus a reduction in charges that is caused by exposure of the pigment, and fogging that is caused as a result thereof are prevented. On the other hand, when the ratio (C/D) is 0.500 or less, excellent brilliance is obtained.

The average maximum thickness C and the average equivalent circle diameter D are measured by the methods below.

Toner particles are placed on a smooth surface and uniformly dispersed by applying vibrations. One thousand toner particles are observed with a color laser microscope "VK-9700" (manufactured by Keyence Corporation) at a magnification of 1,000 times to measure the maximum thickness C and the equivalent circle diameter D of a surface viewed from the top, and the arithmetic averages thereof are calculated to determine the average maximum thickness C and the average equivalent circle diameter D in the brilliant toner particles.

Angle Formed by Long Axis Direction of Toner Particle in Cross Section and Long Axis Direction of Brilliant Pigment Particles When a cross section of a toner particle in the thickness direction thereof is observed, the number of brilliant pigment particles arranged so that an angle formed by a long axis direction of the toner particle in the cross section and a long axis direction of a brilliant pigment particle is in the range of −30° to +30° is preferably 60% or more of the total number of brilliant pigment particles observed. Furthermore, the number is more preferably from 70% to 95%, and particularly preferably from 80% to 90%.

When the above number is 60% or more, a good brilliance may be obtained.

Here, a method of observing the cross section of the toner particles will be described.

Toner particles are embedded in a mixture of a bisphenol A-type liquid epoxy resin and a curing agent to prepare a sample for cutting. Next, the sample for cutting is cut at −100° C. using a cutting machine with a diamond knife, (for example, using an ultramicrotome (Ultracut UCT, manufactured by Leica Microsystems)) to prepare a sample for observation. The sample for observation is observed using an ultrahigh resolution field emission scanning electron microscope (S-4800, manufactured by Hitachi High Technologies Co., Ltd.) with magnification power with which about 1 to 10 toner particles are observed in one view field.

Specifically, the cross section of the toner particles (the cross section of the toner particles in the thickness direction) is observed and regarding the observed 100 toner particles, the number of brilliant pigment particles arranged so that an angle formed by the long axis direction of the toner particles in the cross section and the long axis direction of the brilliant pigment is in a range of −30° to +30° is counted by using, for example, image analysis software (WinROOF) manufactured by Mitani Corporation or using an output sample of the observed image and a protractor and the ratio thereof is calculated.

The term "long axis direction of toner particle in the cross section" refers to a direction orthogonal to a thickness direction of toner brilliant having an average equivalent-circle diameter D larger than the average maximum thickness C, and the term "long axis direction of a brilliant pigment particle" refers to a length direction of the brilliant pigment particle.

The volume average particle diameter of the toner particles according to the exemplary embodiment is preferably from 1 μm to 30 μm, and more preferably from 3 μm to 20 μm.

The volume average particle diameter $D_{50v}$ of the toner particles is determined as follows. A cumulative volume distribution curve and a cumulative number distribution curve are drawn from the smaller particle diameter end, respectively, for each particle diameter range (channel) divided on the basis of a particle diameter distribution measured with a measuring instrument such as a Multisizer II (manufactured by Beckman Coulter Inc.). The particle diameter providing 16% accumulation is defined as that corresponding to volume $D_{16v}$ and number $D_{16p}$, the particle diameter providing 50% accumulation is defined as that corresponding to volume $D_{50v}$ and number $D_{84p}$, and the particle diameter providing 84% accumulation is defined as that corresponding to volume $D_{84v}$ and number $D_{84p}$. The volume average particle diameter distribution index (GSDv) is calculated as $(D_{84v}/D_{16v})^{1/2}$ using these values.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2$ n, $Al_2O_3.2SiO_2$, $CaCO_3$, $MgCO_3$, $BaSO_4$, and $MgSO_4$.

The surfaces of the inorganic particles used as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin) and a cleaning aid (for example, metal salt of higher fatty acid represented by zinc stearate, and fluorine polymer particles).

The amount of the external additive externally added is, for example, preferably from 0.01% by weight to 5% by weight and more preferably from 0.01% by weight to 2.0% by weight, with respect to the toner particles.

Toner Preparing Method

Next, a method of preparing a toner according to the exemplary embodiment will be described.

The toner according to the exemplary embodiment is obtained by externally adding an external additive to toner particles after preparing the toner particles including the brilliant pigment.

The method of preparing toner particles is not particularly limited, and the toner particles may be prepared using any of a dry method, for example, a kneading and pulverizing method and a wet method, for example, an aggregation and coalescence method, a suspension and polymerization method, and a dissolution and suspension method. The toner particle preparing method is not particularly limited to these processes, and a known process is employed.

For example, the dissolution and suspension method is a method of obtaining toner particles by granulation including: dispersing a liquid, formed by dissolving or dispersing materials constituting toner particles (such as resin particles and a brilliant pigment) in an organic solvent in which a binder resin is soluble, in an aqueous solvent containing a particle dispersant, and then removing the organic solvent.

In addition, an emulsion aggregating method is a method of obtaining toner particles including: an aggregation step of forming aggregates of materials constituting toner particles (such as resin particles and a brilliant pigment), and a coalescence step of coalescing the aggregates.

Among these, toner particles including a urea-modified polyester resin as the binder resin may be obtained by the following dissolution and suspension method.

The dissolution and suspension method includes an oil phase liquid preparation step of preparing an oil phase liquid which is a mixed solution obtained by mixing an organic solvent used for dissolving the binder resin, the binder resin, and the brilliant pigment, a suspension preparing step of preparing a suspension by dispersing the oil phase liquid in an aqueous solvent, and a solvent removal step of removing the organic solvent from the suspension.

Examples of the organic solvent used for dissolving the binder resin include ester solvents such as methyl acetate and ethyl acetate; ketone solvents such as methyl ethyl ketone and methyl isopropyl ketone; aliphatic hydrocarbon solvents such as hexane and cyclohexane, and halogenated hydrocarbon solvents such as dichloromethane, chloroform, and trichloroethylene. These organic solvents are preferably capable of dissolving therein the binder resin, preferably have a water solubility (solubility in water at 25° C.) of about from 0% by weight to 30% by weight, and have a boiling temperature of 100° C. or lower. As the organic solvent used for dissolving the binder resin, among these organic solvents, ethyl acetate is preferable.

In the dissolution and suspension method, toner particles having the brilliant pigment embedded in the binder resin are obtained by dissolving the binder resin in an organic solvent, and then removing the organic solvent under the presence of the brilliant pigment. Therefore, it is considered that the structure or the characteristics of toner particles obtained by the suspension preparation step and the solvent removal step may vary as follows depending on the viscosity of the solution in which the binder resin is dissolved in the organic solvent (that is, an oil phase liquid).

Specifically, as described above, when the viscosity of the oil phase liquid is too low, the brilliant pigment particles are not easily incorporated in the oil phase liquid in the suspension preparation step and binder resin particles not including the brilliant pigment or toner particles having a small amount of binder resin are easily obtained. In addition, when the viscosity of the oil phase liquid is too high, a large number of brilliant pigment particles are easily incorporated in the oil phase liquid and toner particles including plural brilliant pigment particles are easily obtained.

From the above viewpoint, the viscosity of the oil phase liquid is from 0.05 Pa·s to 1.5 Pa·s, preferably from 0.1 Pa·s to 1.0 Pa·s, and more preferably from 0.2 Pa·s to 0.8 Pa·s.

The viscosity of the oil phase liquid varies according to the type, the molecular weight, the molecular weight distribution, and the concentration of the binder resin, and the like and the type, the molecular weight, and the molecular weight distribution of the binder resin are as described above.

The concentration of the binder resin in the oil phase liquid is, for example, from 30% by weight to 70% by weight, preferably from 35% by weight to 65% by weight, and more preferably from 40% by weight to 60% by weight.

Hereinafter, a specific example of the dissolution and suspension method will be described but the method is not limited thereto.

In the following description of the dissolution and suspension method, a method of obtaining toner particles including a release agent is described but the release agent is incorporated in the toner particles, if necessary. In addition, a method of obtaining toner particles including an unmodified polyester resin and a urea-modified polyester resin as binder resins will be described but the toner particles may include only the urea-modified polyester resin as a binder resin.

Oil Phase Liquid Preparation Step

An oil phase liquid obtained by dissolving or dispersing toner particle materials including an unmodified polyester resin, a polyester prepolymer having isocyanate groups, an amine compound, a brilliant pigment, and a release agent in an organic solvent is prepared (oil phase liquid preparation step). The oil phase liquid preparation step is a step of obtaining a mixed solution of the toner material by dissolving or dispersing the toner particle materials in the organic solvent.

The oil phase liquid may be prepared by methods such as 1) a preparation method of collectively dissolving or dispersing toner materials in an organic solvent, 2) a preparation method of kneading toner materials in advance, and then dissolving or dispersing the kneaded material in an organic solvent, 3) a preparation method of dissolving an unmodified polyester resin, a polyester prepolymer having isocyanate groups, and an amine compound in an organic solvent, and then dispersing a brilliant pigment and a release agent in the organic solvent, 4) a preparation method of dispersing a brilliant pigment and a release agent in an organic solvent, and then dissolving an unmodified polyester resin, a polyester prepolymer having isocyanate groups, and an amine compound in the organic solvent, 5) a preparation method of dissolving or dispersing toner particle materials (an unmodified polyester resin, a brilliant pigment, and a release agent), other than a polyester prepolymer having isocyanate groups and an amine compound, in an organic solvent, and then dissolving the polyester prepolymer having isocyanate groups and the amine compound in the organic solvent, and 6) a preparation method of dissolving or dispersing toner particle materials (an unmodified polyester resin, a brilliant pigment, and a release agent), other than a polyester prepolymer having isocyanate groups and an amine compound, in an organic solvent, and then dissolving the polyester prepolymer having isocyanate groups or the amine compound in the organic solvent. The method of preparing the oil phase liquid is not limited thereto.

The organic solvent of the oil phase liquid is not particularly limited as long as the organic solvent is an organic solvent capable of dissolving the binder resin. Examples thereof include ester solvents such as methyl acetate and ethyl acetate; ketone solvents such as methyl ethyl ketone and methyl isopropyl ketone; aliphatic hydrocarbon solvents such as hexane and cyclohexane, and halogenated hydrocarbon solvents such as dichloromethane, chloroform, and trichloroethylene. These organic solvents are preferably capable of dissolving therein the binder resin, preferably have a water solubility of about from 0% by weight to 30% by weight, and have a boiling temperature of 100° C. or lower. Among these organic solvents, ethyl acetate is preferable.

Suspension Preparation Step

Next, the obtained oil phase liquid is dispersed in a water phase liquid to prepare a suspension (suspension preparation step).

Reaction between the polyester prepolymer having isocyanate groups and the amine compound is conducted with preparation of the suspension. Then, a urea-modified polyester resin is formed by the reaction. This reaction accompanies at least one of crosslinking reaction and elongation reaction in a molecular chain. The reaction between the polyester prepolymer having isocyanate groups and the amine compound may be conducted with an organic solvent removal step, which will be described later.

Here, the reaction conditions are selected according to reactivity between the isocyanate group structure of the polyester prepolymer and the amine compound. For example, the reaction time is preferably from 10 minutes to 40 hours and more preferably from 2 hours to 24 hours. The reaction temperature is preferably from 0° C. to 150° C. and more preferably from 40° C. to 98° C. For the formation of the urea-modified polyester resin, if necessary, known catalyst (such as dibutyltin laurate and dioctyltin laurate) may be used. That is, a catalyst may be added to the oil phase liquid or the suspension.

Examples of the water phase liquid include water phase liquids in which a particle dispersant such as an organic particle dispersant or an inorganic particle dispersant is dispersed in an aqueous solvent. Examples of the water phase liquid also include water phase liquids in which a particle dispersant is dispersed in an aqueous solvent and a polymer dispersant is dispersed in the aqueous solvent. Known additives such as a surfactant may be added to the water phase liquid.

The aqueous solvent may be water (for example, generally, ion exchange water, distilled water, and pure water). The aqueous solvent may be a solvent including an organic solvent such as alcohols (such as methanol, isopropyl alcohol, and ethylene glycol), dimethylformamide, tetrahydrofuran, cellosolves (such as methyl cellosolve), or lower ketones (such as acetone, and methyl ethyl ketone), together with water.

Examples of the organic particle dispersant include hydrophilic organic particle dispersants. Examples of the organic particle dispersant include particles of alkyl poly (meth)acrylate resin (for example, polymethyl methacrylate resin), and polystyrene resin, poly(styrene-acrylonitrile) resin. Examples of the organic particle dispersant also include particles of styrene acrylic resin.

Examples of the inorganic particle dispersant include hydrophilic inorganic particle dispersants. Specific examples of the inorganic particle dispersant include particles of silica, alumina, titania, calcium carbonate, magnesium carbonate, tricalcium phosphate, clay, diatomaceous earth, and bentonite and particles of calcium carbonate are preferable. The inorganic particle dispersants may be used alone or in combination of two or more kinds thereof.

The particle dispersant may be surface-treated with a polymer having a carboxyl group.

Examples of the polymer having a carboxyl group include copolymers between an α,β-monoethylenically unsaturated carboxylic ester and an α,β-monoethylenically unsaturated carboxylic acid or at least one selected from salts (such as alkali metal salts, alkaline earth metal salts, ammonium salts, and amine salts) obtained by neutralizing the carboxyl group of an α,β-monoethylenically unsaturated carboxylic acid with an alkali metal, an alkaline earth metal, ammonium or amine. Examples of the polymer having a carboxyl group also include salts (such as alkali metal salts, alkaline earth metal salts, ammonium salts and amine salts) obtained by neutralizing the carboxyl group of a copolymer between an α,β-monoethylenically unsaturated carboxylic acid and an α,β-monoethylenically unsaturated carboxylate ester with an alkali metal, an alkaline earth metal, ammonium or amine. The polymers having a carboxyl group may be used alone or in combination of two or more kinds thereof.

Representative examples of the α,β-monoethylenically unsaturated carboxylic acid include α,β-unsaturated monocarboxylic acids (such as acrylic acid, methacrylic acid, and crotonic acid), and α,β-unsaturated dicarboxylic acids (such as maleic acid, fumaric acid, and itaconic acid). In addition, representative examples of the α,β-monoethylenically unsaturated carboxylic ester include alkyl esters of (meth) acrylic acid, (meth)acrylates having an alkoxy group, (meth) acrylates having a cyclohexyl group, (meth)acrylates having a hydroxy group, and polyalkylene glycol mono(meth) acrylates.

Examples of the polymer dispersant include hydrophilic polymer dispersants. Specific examples of the polymer dispersant include polymer dispersants having a carboxyl group and not having a lipophilic group (such as a hydroxypropoxy group or a methoxy group) (for example, water-soluble cellulose esters such as carboxymethyl cellulose, and carboxyethyl cellulose).

Solvent Removal Step

Next, a toner particle dispersion is obtained by removing the organic solvent from the obtained suspension (solvent removal step). In the solvent removal step, a toner particle dispersion is obtained by removing the organic solvent included in the water phase liquid dispersed in the suspension. The organic solvent removal from the suspension may be performed immediately after the suspension preparation step, but may be performed when at least one minute has passed after the completion of the suspension preparation step.

In the solvent removal step, the organic solvent may be removed from the suspension by cooling or heating the obtained suspension to, for example, a range of 0° C. to 100° C.

As a specific method of removing the organic solvent, the following methods may be used.

(1) A method in which air is blown into the suspension to forcibly renew the gas phase on the surface of the suspension. In this case, a gas may be blown into the suspension.

(2) A method in which the pressure is reduced. In this case, the gas phase on the surface of the suspension may be forcibly renewed by purging with a gas or moreover, a gas may be blown into the suspension.

Toner particles are obtained through the following steps.

Here, after the completion of the solvent removal step, toner particles formed in the toner particle dispersion are subjected to known steps including a washing step, a solid-liquid separation step, and a drying step and thus dry toner particles are obtained.

The washing step may be performed by sufficient substitution and washing with ion exchange water from the viewpoint of charging properties.

In addition, the solid-liquid separation step is not particularly limited and suction filtration, pressure filtration, and the like may be used from the viewpoint of productivity. In addition, the drying step is not particularly limited and from the viewpoint of productivity, freeze-drying, flush-jet drying, fluidized drying, or vibrating fluidized drying may be used.

Then, the toner according to the exemplary embodiment may be prepared by adding an external additive to the obtained dry toner particles and mixing the materials.

The mixing may be performed by using a V blender, a Henschel mixer, a ready-gel mixer, and the like.

Further, if necessary, coarse toner particles may be removed by using a vibration classifier, a wind classifier, and the like.

Electrostatic Charge Image Developer

An electrostatic charge image developer according to the exemplary embodiment at least includes the toner according to the exemplary embodiment.

The electrostatic charge image developer according to the exemplary embodiment may be a single component developer including only the toner according to the exemplary embodiment or may be a two-component developer obtained by mixing the toner and a carrier.

The carrier is not particularly limited and known carriers may be used. Examples of the carrier include resin coated carriers in which the surface of the core formed of magnetic particles is coated with a resin; magnetic particle dispersion type carriers in which magnetic particles are dispersed and blended in a matrix resin; and resin impregnation type carriers in which porous magnetic particles are impregnated with a resin.

The magnetic particle dispersion type carriers and the resin impregnation type carriers may be carriers in which the constituent particles of the carrier are cores and the surface is coated with a resin.

Examples of the magnetic particles include magnetic metals such as iron, nickel, and cobalt, and magnetic oxides such as ferrite and magnetite.

Examples of the coating resin and the matrix resin include, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resin including organosiloxane bonds and its modified products, fluorine resin, polyester, polycarbonate, phenolic resin, and epoxy resin. The coating resin and the matrix resin may include an additive such as conductive particles.

Examples of the conductive particles include metals such as gold, silver, and copper, and particles of carbon black, titanium oxide, zinc oxide, tin oxide, barium sulfate, aluminum borate, and potassium titanate.

The surface of the core may be coated with the resin by a method of using a coating layer forming solution obtained by dissolving a coating resin and various additives (used if necessary) in an appropriate solvent. The solvent is not particularly limited and may be selected in consideration of the kind of the coating resin to be used, the coating suitability and the like. Specific examples of the resin coating method include a dipping method of dipping cores in a coating layer forming solution, a spraying method of spraying a coating layer forming solution onto surfaces of cores, a fluidized bed method of spraying a coating layer forming solution onto cores in a state in which the cores are allowed to float by flowing air, and a kneader-coater method in which cores of a carrier and a coating layer forming solution are mixed with each other in a kneader-coater and then the solvent is removed.

The mixing ratio (weight ratio) between the toner and the carrier in the two-component developer is preferably from toner:carrier=1:100 to 30:100, and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member with the electrostatic charge image developer to forma toner image, a transfer unit that transfers the toner image formed onto the surface of the image holding member to a surface of a recording medium, and a fixing unit that fixes the toner image transferred onto the surface of the recording medium.

As the electrostatic charge image developer, the electrostatic charge image developer according to this exemplary embodiment is applied.

In the image forming apparatus according to this exemplary embodiment, an image forming method (image forming method according to this exemplary embodiment) including the steps of: charging a surface of an image holding member; forming an electrostatic charge image on the charged surface of the image holding member; developing the electrostatic charge image formed on the surface of the image holding member with the electrostatic charge image developer according to this exemplary embodiment to form a toner image; transferring the toner image formed onto the surface of the image holding member to a surface of a recording medium; and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is suitably used.

Hereinafter, an example of the image forming apparatus according to this exemplary embodiment will be shown. However, the image forming apparatus is not limited thereto. Main portions shown in the drawing will be described, but descriptions of other portions will be omitted.

Figure 2:
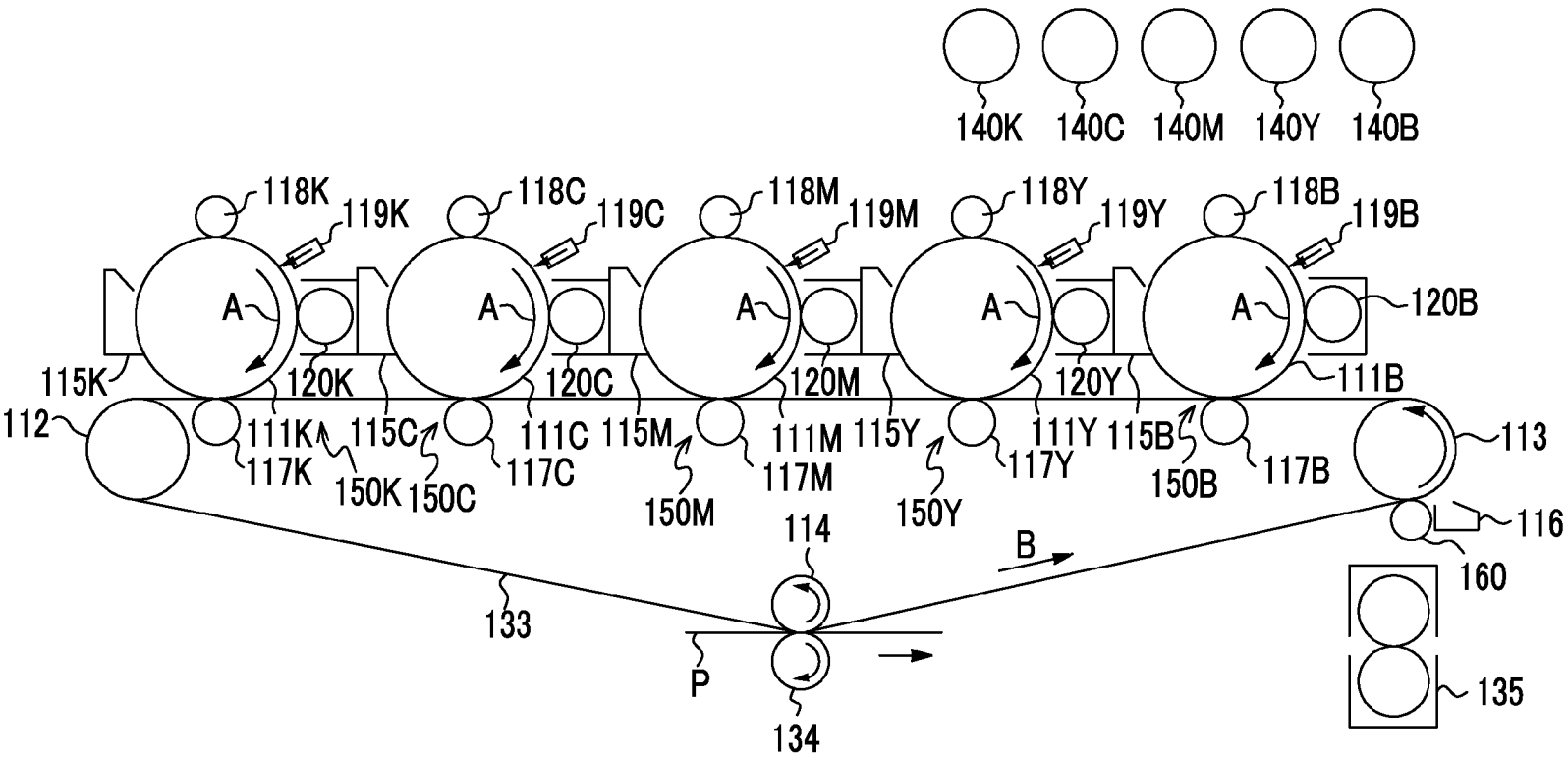
FIG. 2 is a schematic configuration diagram showing an example of an image forming apparatus according to an exemplary embodiment.

FIG. 2 is a schematic configuration diagram showing the image forming apparatus according to the exemplary embodiment. The image forming apparatus according to the exemplary embodiment relates to a tandem type configuration provided with plural photoreceptors as an image holding member, that is, plural image forming units (image forming units) and is provided with an intermediate transfer belt as an intermediate transfer member.

As shown in FIG. 2, in the image forming apparatus according to the exemplary embodiment, an image forming unit 150B that forms a metallic toner image using the developer according to the exemplary embodiment, and four image forming units 150Y, 150M, 150C, and 150K that form respective color toner images of yellow, magenta, cyan, and black are arranged in parallel (in tandem) at intervals. The respective image forming units 150K, 150C, 150M, 150Y, and 150B are arranged in this order from a downstream side in a rotating direction of an intermediate transfer belt 133.

Since the respective image forming units 150B, 150Y, 150M, 150C, and 150K have the same configuration except for the color of the toner in the developer accommodated therein, the image forming unit 150B that forms a metallic toner image will be described as a representative example. In addition, the same components as those of the image forming unit 150K are represented by reference numerals to which the symbols yellow (Y), magenta (M), cyan (C), and black (K) are attached, instead of metallic (B), and the descriptions of the image forming units 150Y, 150M, 150C, and 150K will be omitted.

The metallic image forming unit 150B is provided with a photoreceptor 111B as an image holding member, and this photoreceptor 111B is driven by a drive unit (not shown) to rotate in the direction of the arrow A shown in the drawing at a predetermined process speed. As the photoreceptor 111B, for example, an organic photoreceptor having sensitivity to an infrared region is used.

A charging roller (charging unit) 118B is provided on the photoreceptor 111B. A predetermined voltage is applied to the charging roller 118B by a power supply (not shown), and a surface of the photoreceptor 111B is charged to a predetermined potential.

Around the photoreceptor 111B, an exposure device (electrostatic charge image forming unit) 119B that forms an electrostatic charge image by subjecting the surface of the photoreceptor 111B to exposure is arranged on the downstream side of the charging roller 118B in the rotating direction of the photoreceptor 111B.

Here, as the exposure device 119B, a LED array that may be miniaturized is used due to the space. However, the exposure device is not limited thereto and other electrostatic charge image forming units using laser beams and the like may also be used. However, the wavelength of the light source is in the range of spectral sensitivity of the photoreceptor. For example, in the case of using semiconductor lasers, the mainstream of the wavelength of the semiconductor lasers is near infrared that has having an oscillation wavelength of near 780 nm. However, the wavelength is not limited thereto. For example, lasers having oscillation wavelengths on the order of 600 nm and blue lasers having oscillation wavelengths near the range of 400 nm to 450 nm may also be used. Moreover, in order to forma color image, it is also effective to use surface emission laser light sources that output multibeam.

Around the photoreceptor 111B, a developing device (developing unit) 120B provided with a developer holding member that holds a metallic color developer is arranged on the downstream side of the exposure device 119B in the rotating direction of the photoreceptor 111B and forms a toner image on the surface of the photoreceptor 111B by developing electrostatic charge image formed on the surface of the photoreceptor 111B with a metallic color toner.

An intermediate transfer belt 133 onto which a toner image formed on the surface of the photoreceptor 111B is primarily transferred is arranged under the photoreceptor 111B so as to extend under five photoreceptors 111B, 111Y, 111M, 111C, and 111K. The intermediate transfer belt 133 is pressed against the surface of the photoreceptor 111B by a primary transfer roller 117B (primary transfer unit).

In addition, the intermediate transfer belt 133 is supported by three rollers of a driving roller 112, a support roller 113, and a bias roller 114, and is rotated in the direction of the arrow B at a moving speed equal to the process speed of the photoreceptor 111B. Then, a drive roller 112 also functions as an intermediate transfer member erasing unit that erases the charge accumulated on the intermediate transfer belt 133.

The metallic toner image is primarily transferred onto a surface of the intermediate transfer belt 133, and further respective color toner images of yellow, magenta, cyan, and black color are sequentially primarily transferred and layered thereonto. Then, the charge is erased by the drive roller 112.

On a side opposite to the support roller 113 with the intermediate transfer belt 133 interposed therebetween, a belt cleaner 116 that cleans an outer peripheral surface of the intermediate transfer belt 133 is provided to be pressed against the support roller 113. In addition, on an upstream side of the belt cleaner 116 in the rotating direction of the intermediate transfer belt 133, a voltage applying device 160 as the arranging unit that applies an electric field between the voltage applying device 160 and the intermediate transfer belt 133 by generating a potential difference between the voltage applying device 160 and the support roller 113 is provided.

Since the strength of the intermediate transfer belt 133 is high and may satisfy durability, it is preferable that the intermediate transfer belt 133 contains a polyimide resin or a polyamideimide resin. In addition, the surface resistivity of the intermediate transfer belt 133 is preferably in a range of $1\times10^{9}$ Ω/square to $1\times10^{14}$ Ω/square. In order to control the surface resistivity, the intermediate transfer belt 133 includes a conductive filler, if necessary. Examples of the conductive filler include metals or alloys such as carbon black, graphite, aluminum, or copper alloys; metal oxides such as tin oxide, zinc oxide, potassium titanate, tin oxide-indium oxide composite oxide or tin oxide-antimony oxide composite oxide; and conductive polymers such as polyaniline. These conductive fillers may be used alone or in a combination of two or more kinds. Among these, carbon black is preferable as the conductive filler from the viewpoint of cost. In addition, if necessary, processing auxiliary agents such as a dispersant or a lubricant may be added.

In addition, around the photoreceptor 111B, a cleaning device 115B that cleans toner, which remains on or is retransferred onto the surface of the photoreceptor 111B, is arranged on a downstream side of the primary transfer roller 117B in the rotating direction (the direction of the arrow A) of the photoreceptor 111B. As the cleaning device 115B, a cleaning blade type device is used as described above. The cleaning blade of the cleaning device 115B is attached to be pressed against the surface of the photoreceptor 111B in a counter direction.

The material for the cleaning blade is not particularly limited and various elastic members may be used. Specific examples of the elastic members include elastic members such as polyurethane elastic members, silicone rubber, and chloroprene rubber.

As the polyurethane elastic member, a polyurethane that is generally synthesized by addition reaction of an isocyanate, a polyol and various hydrogen-containing compounds is used. This is produced by preparing a urethane prepolymer using a polyol component including polyether polyols such as polypropylene glycol and polytetramethylene glycol, and polyester polyols such as adipate polyols, polycaprolactum polyols and polycarbonate polyols, and an isocyanate component including aromatic polyisocyanates such as trirenediisocyanate, 4,4'-diphenylmethanediisocyanate, polymethylenepolyphenylpolyisocyanate and toluidine diisocyanate, and aliphatic polyisocyanates such as hexamethylenediisocyanate, isophorone diisocyanate, xylylene diisocyanate and dicyclohexylmethanediisocyanate, adding a curing agent to the prepolymer, pouring the mixture into a mold; curing the mixture by crosslinking, and aging the product at normal temperature (25° C.). As the curing agent, typically, divalent alcohols such as 1,4-butanediol and a tri- or higher-valent multivalent alcohol such as trimethylol propane and pentaerythritol may be used in combination.

When a rubber hardness (according to Durometer type A of JIS K 6253-3:2012) of the cleaning blade is 50° or greater, the cleaning blade is not easily worn. Therefore, toner-passing-through does not easily occur. When the rubber hardness is 100° or less, the cleaning blade is not so hard. Therefore, the image holding member is not easily worn, and deterioration in cleaning performance is prevented.

In addition, when a 300% modulus indicating a tensile stress at an elongation of a sample of 300% is 80 kgf/cm$^2$ or more, a blade edge is not easily deformed or torn. Therefore, the cleaning blade has a strong resistance to cracking and wear, and thus toner-passing-through does not easily occur. On the other hand, when the 300% modulus is 550 kgf/cm$^2$ or less, the followability of the cleaning blade on the surface shape of the image holding member is prevented from deteriorating due to the deformation of the cleaning blade. Therefore, cleaning failure caused by contact failure is prevented.

Further, in the cleaning blade in which the rebound resilience defined in the test method of rebound resilience according to JIS K 6255:1996 (hereinafter simply referred to as "rebound resilience") is 4% or more, the reciprocation of a blade edge for scraping toner easily occur, and thus toner-passing-through does not easily occur. In addition, in the cleaning blade in which the rebound resilience is 85% or less, squeal made from the blade and the curling of the blade are prevented.

In addition, the deformation amount of the cleaning blade (amount of the cleaning blade deformed by being pressed against the surface of the image holding member) varies depending on the situation, but is preferably from about 0.8 mm to about 1.6 mm and more preferably from about 1.0 mm to about 1.4 mm. Further, the contact angle of the cleaning blade with the image holding member (angle formed between the tangent line of the surface of the image holding member and the cleaning blade) varies depending on the situation, but is preferably from about 18° to about 28°.

A secondary transfer roller (secondary transfer unit) 134 is pressed against a bias roller 114, which supports the intermediate transfer belt 133, through intermediate transfer belt 133. The toner images which are primarily transferred and layered onto the surface of the intermediate transfer belt 133 are electrostatically transferred onto a surface of a recording sheet (recording medium) P, which is supplied from a sheet cassette (not shown), in a nip portion between the bias roller 114 and the secondary transfer roller 134. At this time, among the toner images which are transferred and layered onto the intermediate transfer belt 133, the metallic toner image is located on the bottom surface (lowermost layer). Therefore, among the toner images which are transferred onto the surface of the recording sheet P, the metallic toner image is located on the top surface (uppermost layer).

In addition, a fixing device (fixing unit) 135 that fixes the toner images, which are multiply transferred onto the recording sheet P, to the surface of the recording sheet P with heat and pressure to form a permanent image is arranged on a downstream side of the secondary transfer roller 134.

Examples of the fixing unit 135 include a belt-shape fixing belt in which a low surface energy material represented by a fluororesin component or a silicone resin is used for a surface thereof; and a cylindrical fixing roller in which a low surface energy material represented by a fluororesin component or a silicone resin is used for a surface thereof.

Next, the operations of the respective image forming units 150B, 150Y, 150M, 150C, and 150K that form the respective color images of metallic color, yellow, magenta, cyan, and black, will be described. Since the operations of the respective image forming units 150B, 150Y, 150M, 150C, and 150K are the same, the operation of the metallic image forming unit 150B will be described as a representative example.

In the metallic image forming unit 150B, the photoreceptor 111B rotates in the direction of the arrow A at a predetermined process speed. The surface of the photoreceptor 111B is negatively charged to a predetermined potential by the charging roller 118B. Then, the surface of the photoreceptor 111B is exposed to light by the exposure device 119B such that an electrostatic charge image is formed according to image information. Next, the negatively charged toner is reversely developed by the developing device 120B such that the electrostatic charge image formed on the surface of the photoreceptor 111B is visualized and formed as a toner image on the surface of the photoreceptor 111B. Next, the toner image formed on the surface of the photoreceptor 111B is primarily transferred onto the surface of the intermediate transfer belt 133 by the primary transfer roller 117B. After the primary transfer, a transfer residual component such as toner remaining on the surface of the photoreceptor 111B is scraped and cleaned by the cleaning blade of the cleaning device 115B. As a result, the photoreceptor 111B is ready for the next image forming process.

The above-described operation is performed in the respective image forming units 150B, 150Y, 150M, 150C, and 150K. The toner images which are visualized on the surfaces of the respective photoreceptors 111B, 111Y, 111M, 111C, and 111K are sequentially multiply transferred onto the surface of the intermediate transfer belt 133. In a color mode, the respective color toner images of metallic color, yellow, magenta, cyan, black are multiply transferred in this order. However, in a two-color mode or a three-color mode, only necessary color toner images are singly or multiply transferred in the above-described order. Next, the intermediate transfer belt 133 onto which the toner images are singly or multiply transferred is erased by the drive roller 112.

Then, the toner images which are singly or multiply transferred onto the surface of the intermediate transfer belt 133 are secondarily transferred onto the surface of the recording sheet P, which is supplied from the sheet cassette (not shown), by the secondary transfer roller 134. Next, the toner images are fixed with heat and pressure by the fixing device 135. Toner remaining on the surface of the intermediate transfer belt 133 after the secondary transfer is caused to rise from the surface of the intermediate transfer belt 133 by the voltage applying device 160 as an arranging unit that applies an electric field between the voltage applying device 160 and the intermediate transfer belt 133. Then, the remaining toner is cleaned by the belt cleaner 116 including the cleaning blade for the intermediate transfer belt 133.

The metallic image forming unit 150B is configured as a process cartridge which is detachable from the image forming apparatus main body and in which the developing device 120B that includes a developer holding member for holding a metallic color electrostatic charge image developer is integrated with the photoreceptor 111B, the charging roller 118B, and the cleaning device 115B. In addition, similarly to case of the image forming unit 150B, the image forming units 150Y, 150M, 150C, and 150K are also configured as process cartridges.

In addition, the toner cartridges 140B, 140Y, 140M, 140C, and 140K accommodate the respective color toners, are detachable from the image forming apparatus, and are connected to the developing devices corresponding to the respective colors through toner supply tubes (not shown). When the amount of the toner accommodated in each toner cartridge is small, this toner cartridge is replaced with another one.

In the exemplary embodiment, the respective image forming units are arranged on the downstream side in the rotating direction of the intermediate transfer belt 133 such that the image forming units 150K, 150C, 150M, 150Y, and 150B are arranged in this order. However, the exemplary embodiment is not limited thereto and for example, the image forming units 150B, 150K, 150C, 150M, and 150Y may be arranged in this order.

In the exemplary embodiment, the charging rollers 118B, 118Y, 118M, 118C, and 118K are used as charging devices. However, the exemplary embodiment is not limited thereto and for example, a contact type charging member using a charging brush, a charging film, a charging rubber blade, a charging tube and the like, a non-contact type charging member, a known charger using corona discharge such as a scorotron charging member or a corotron charging member may also be used.

In the exemplary embodiment, the primary transfer roller is used as the primary transfer unit and the secondary transfer roller is used as the secondary transfer unit. However, the exemplary embodiment is not limited thereto and for example, a contact type transfer charging member using a belt, a film, a rubber blade, and the like, a known transfer charger using corona discharge such as a scorotron transfer charging member or a corotron transfer charging member may also be used.

In the image forming apparatus according to the exemplary embodiment, the arranging unit that causes toner remaining on the surface of the intermediate transfer member after the transfer to rise from the surface of the intermediate transfer member is provided. However, another arranging unit that causes toner remaining on the surface of the image holding member after the transfer to rise from the surface of the intermediate transfer member may be further provided and these arranging units may not be provided.

In addition, the image forming apparatus according to the exemplary embodiment has a tandem type configuration provided with plural image forming units. However, the exemplary embodiment is not limited thereto and only an image forming unit that forms a toner image using the developer according to the exemplary embodiment may be provided in the image forming apparatus.

Process Cartridge and Toner Cartridge

A process cartridge according to the exemplary embodiment will be described.

The process cartridge according to the exemplary embodiment is a process cartridge including a developing unit which accommodates the electrostatic charge image developer according to the exemplary embodiment and develops an electrostatic charge image formed on a surface of an image holding member as a toner image with the electrostatic charge image developer, and is detachable from the image forming apparatus.

Without being limited to the configuration described above, the process cartridge according to the exemplary embodiment may have a configuration including a developing device, and, if necessary, at least one selected from other units such as an image holding member, a charging unit, an electrostatic charge image forming unit, and a transfer unit.

Hereinafter, an example of the process cartridge according to the exemplary embodiment will be shown. However, there is no limitation thereto. Main portions shown in the drawing will be described, but descriptions of other portions will be omitted.

Figure 3:
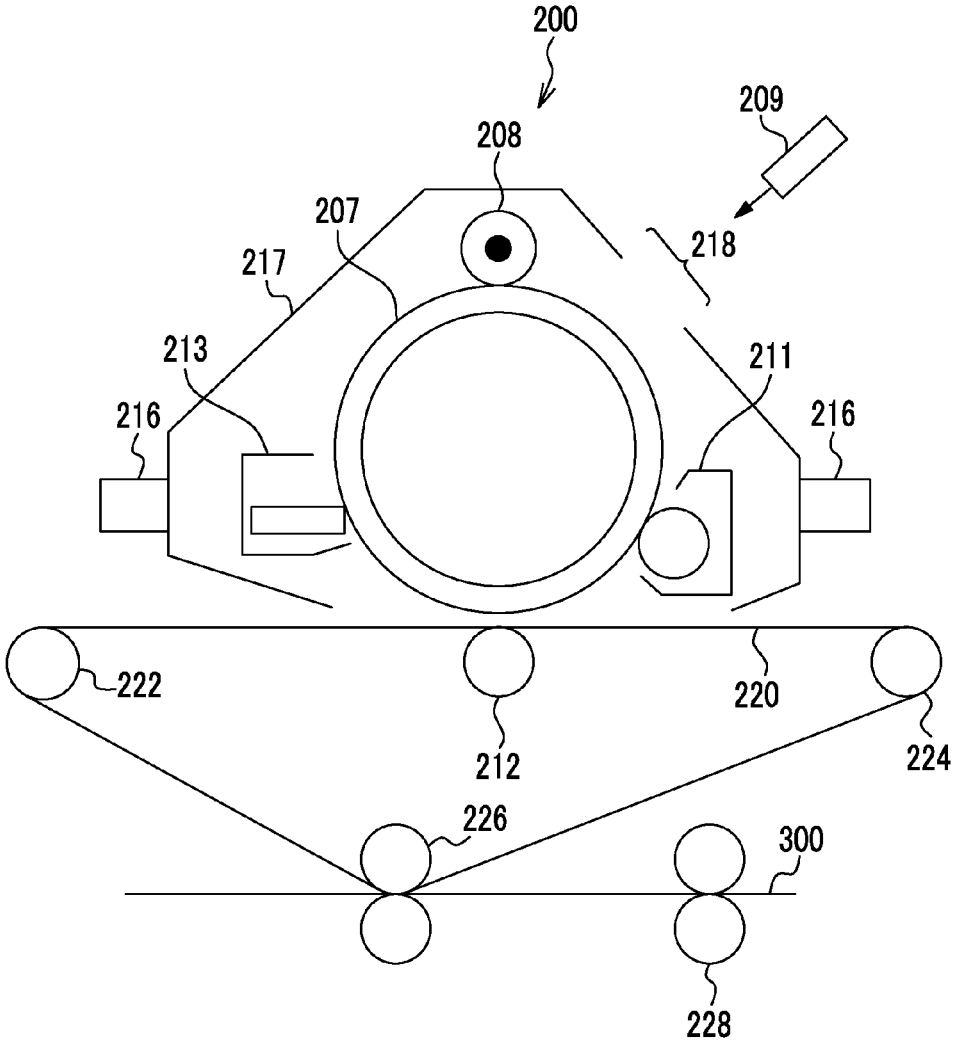
FIG. 3 is a schematic configuration diagram showing an example of a process cartridge according to an exemplary embodiment.

FIG. 3 is a schematic configuration diagram showing the process cartridge according to the exemplary embodiment.

A process cartridge 200 shown in FIG. 3 is formed as a cartridge having a configuration in which a photoreceptor 207 (an example of the image holding member), a charging roller 208 (an example of the charging unit) provided around the photoreceptor 207, a developing device 211 (an example of the developing unit), and a photoreceptor cleaning device 213 (an example of the cleaning unit) are integrally combined and held by, for example, a housing 217 provided with a mounting rail 216 and an opening 218 for exposure.

In FIG. 3, the reference numeral 209 represents an exposure device (an example of the electrostatic charge image forming unit), the reference numeral 212 represents a primary transfer roller (an example of the primary transfer unit), the reference numeral 220 represents an intermediate transfer belt (an example of the intermediate transfer member), the reference numeral 222 represents a drive roller which also functions as an intermediate transfer belt erasing unit (an example of the intermediate transfer member erasing unit), the reference numeral 224 represents a support roll, the reference numeral 226 represents a secondary transfer roller (an example of the secondary transfer unit), the reference numeral 228 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment may be configured to accommodate the toner according to the exemplary embodiment and be detachable from an image forming apparatus. The toner cartridge according to the exemplary embodiment may accommodate at least toner and may accommodate, for example, a developer according to the configuration of the image forming apparatus.

EXAMPLES

Hereinafter, the exemplary embodiment will be described in detail with reference to examples but the exemplary embodiment is not limited to these examples. In the following description, unless specified otherwise, "part (s)" and "%" are all based on weight.

Preparation of Unmodified Amorphous Polyester Resin (1)

Terephthalic acid: 1,243 parts

Bisphenol A ethylene oxide adduct: 1,830 parts

Bisphenol A propylene oxide adduct: 840 parts

The above-described components are mixed and heated at 180° C., and then 3 parts of dibutyltin oxide are added thereto. The mixture is heated at 220° C. to distill away water, and thus unmodified amorphous polyester resin is obtained. The glass transition temperature Tg of the obtained unmodified amorphous polyester resin is 60° C., the acid value is 3 mgKOH/g, the hydroxyl value is 1 mgKOH/g, the Z average molecular weight Mz is 34,500, the weight average molecular weight Mw is 9,500, the number average molecular weight Mn is 3,100, and the peak top molecular weight Mp is 5,700.

Preparation of Unmodified Crystalline Polyester Resin (1)

Sebacic acid: 102 parts 1,9-Nonanediol: 85 parts

The above-described components are put into a reaction vessel equipped with a stirrer, a thermometer, a condenser, and a nitrogen gas inlet tube, and then the reaction vessel is purged with a dry nitrogen gas. Thereafter, 0.47 parts of titanium tetrabutoxide (regent) are added thereto. The mixture is stirred at 170° C. for 3 hours under a nitrogen gas stream and allowed to react, and then the temperature is further raised to 210° C. over 1 hour. The pressure in the reaction vessel is reduced to 3 kPa and the mixture is stirred and allowed to react for 13 hours under reduced pressure to obtain an unmodified crystalline polyester resin. The melting temperature of the obtained unmodified crystalline polyester resin by DSC is 71.2° C., the weight average molecular weight Mw by GPC is 25,000, the number average molecular weight Mn is 10,500, the Z average molecular weight Mz is 38,000, and the peak top molecular weight Mp is 25,000.

Preparation of Polyester Prepolymer (1)

Terephthalic acid: 1,243 parts

Bisphenol A ethylene oxide adduct: 1,830 parts

Bisphenol A propylene oxide adduct: 840 parts

The above-described components are mixed and heated at 180° C., and then 3 parts of dibutyltin oxide are added thereto. The mixture is heated at 220° C. to distill away water, and thus a polyester prepolymer is obtained. 350 parts of the obtained polyester prepolymer, 50 parts of tolylene diisocyanate, and 450 parts of ethyl acetate are put into a vessel, and the mixture is heated to 130° C. for 3 hours. Thus, a polyester prepolymer (1) having isocyanate groups (hereinafter, referred to as "isocyanate-modified polyester prepolymer (1)") is obtained. The Z average molecular weight Mz of the isocyanate-modified polyester prepolymer (1) is 11,000, the weight average molecular weight Mw is 5,000, the number average molecular weight Mn is 3,100, and the peak top molecular weight Mp is 4,500.

Preparation of Ketimine Compound (1)

parts of methyl ethyl ketone and 150 parts of hexamethylenediamine are put into a vessel and stirred at 60° C. to obtain a ketimine compound (1).

Preparation of Brilliant Pigment Dispersion (1)

Aluminum pigment (flake-shaped brilliant pigment, 2173EA, manufactured by Showa Aluminum Powder K.K.): 100 parts Ethyl acetate: 500 parts The above-described components are mixed, the mixture is filtered, and the filtrate is mixed with 500 parts of ethyl acetate. This operation is repeated 5 times and then the resultant mixture is dispersed using an emulsifying disperser Cavitron (CR1010, manufactured by Pacific Machinery & Engineering Co., Ltd.) for about 1 hour. Thus, a brilliant pigment dispersion (1) (solid concentration: 10%) in which a brilliant pigment (aluminum pigment) is dispersed is obtained.

Preparation of Release Agent Dispersion (1)

Paraffin wax (melting temperature: 89° C.): 30 parts

Ethyl acetate: 270 parts

The above-described components are wet-pulverized by a microbead disperser (DCP mill) in a state of being cooled to 10° C. to obtain a release agent dispersion (1).

Preparation of Oil Phase Liquid (1)

Unmodified amorphous polyester resin (1): 136 parts

Unmodified crystalline polyester resin (1): 15 parts

Brilliant pigment dispersion (1): 500 parts

Ethyl acetate: 56 parts

The above-described components are stirred and mixed, and then 75 parts of the release agent dispersion (1) is added to the obtained mixture, followed by stirring. Thus, an oil phase liquid (1) is obtained.

Preparation of Styrene Acryl Resin Particle Dispersion (1)

Styrene: 370 parts n-Butyl acrylate: 30 parts

Acrylic acid: 4 parts

Dodecanthiol: 24 parts

Carbon tetrabromide: 4 parts

A mixture obtained by mixing and dissolving above-described components is dispersed in an aqueous solution in which 6 parts of a nonionic surfactant (Nonipol 400, manufactured by Sanyo Chemical Industries, Ltd.) and 10 parts of an anionic surfactant (Neogen SC, manufactured by DKS Co. Ltd.) are dissolved in 560 parts of ion exchange water, and the dispersion is emulsified in a flask. Then, while mixing the components for 10 minutes, an aqueous solution in which 4 parts of ammonium persulphate is dissolved in 50 parts of ion exchange water is added thereto, and the flask is purged with nitrogen. Then, the content in the flask is heated in an oil bath, while stirring, until the temperature reaches 70° C., and allowed for emulsion polymerization for 5 hours. Thus, a styrene acryl resin particle dispersion (1) is obtained by dispersing resin particles having an average particle size of 180 nm and a weight average molecular weight (Mw) of 15,500 (resin particle concentration: 40% by weight). The glass transition temperature of the styrene acryl resin particles is 59° C.

Preparation of Water Phase Liquid (1)

Styrene acryl resin particle dispersion (1): 60 parts

2% Aqueous Cerogen BS-H solution (manufactured by DKS Co. Ltd.): 200 parts

Ion exchange water: 200 parts

The above-described components are stirred and mixed to obtain a water phase liquid (1).

Example 1

Preparation of Toner Particles (1)

Oil phase liquid (1): 300 parts

Isocyanate-modified polyester prepolymer (1): 49 parts

Ketimine compound (1): 1.2 parts

The above-described components are out into a vessel and stirred for 2 minutes with a homogenizer (Ultra Turrax, manufactured by IKA Japan K.K.) and thus an oil phase liquid (1P) is obtained. Then, 1,000 parts of the water phase liquid (1) are added into the vessel and the components are stirred for 20 minutes with the homogenizer. Next, the mixed solution is stirred for 48 hours at room temperature (25° C.) and normal pressure (1 atmosphere) with a propeller-type stirrer. Then, the isocyanate-modified polyester prepolymer (1) is allowed to react with the ketimine compound (1) to form a urea-modified polyester resin, and the organic solvent is removed to form a particulate material. Next, the particulate material is washed with water, dried and classified to obtain toner particles (1). The volume average particle diameter of the toner particles is 12 μm.

Preparation of Brilliant Toner (1)

100 parts of the toner particles (1), 1.5 parts of hydrophobic silica (RY50, manufactured by Nippon Aerosil Co.), and 1.0 part of hydrophobic titanium oxide (T805, manufactured by Nippon Aerosil Co.) are mixed using a sample mill at 10,000 rpm for 30 seconds. Then, the resultant is sieved with a vibration sieve having an opening of 45 μm to obtain a brilliant toner (1).

Example 2

Toner particles (2) are obtained in the same manner as in the preparation of the toner particles (1) except that the amount of the oil phase liquid (1) in the preparation of the toner particles (1) is changed to 295 parts, the amount of the isocyanate-modified polyester prepolymer (1) is changed to 70 parts, and the amount of the ketimine compound (1) is changed to 3.0 parts.

A brilliant toner (2) is obtained in the same manner as in the preparation of the brilliant toner (1) except that the toner particles (2) are used.

Example 3

Toner particles (3) are obtained in the same manner as in the preparation of the toner particles (1) except that the amount of the oil phase liquid (1) in the preparation of the toner particles (1) is changed to 320 parts, the amount of the isocyanate-modified polyester prepolymer (1) is changed to 32 parts, and the amount of the ketimine compound (1) is changed to 0.8 parts.

A brilliant toner (3) is obtained in the same manner as in the preparation of the brilliant toner (1) except that the toner particles (3) are used.

Example 4

Toner particles (4) are obtained in the same manner as in the preparation of the toner particles (1) except that the amount of the oil phase liquid (1) in the preparation of the toner particles (1) is changed to 280 parts, the amount of the isocyanate-modified polyester prepolymer (1) is changed to 75 parts, and the amount of the ketimine compound (1) is changed to 1.3 parts.

A brilliant toner (4) is obtained in the same manner as in the preparation of the brilliant toner (1) except that the toner particles (4) are used.

Example 5

Toner particles (5) are obtained in the same manner as in the preparation of the toner particles (1) except that the amount of the oil phase liquid (1) in the preparation of the toner particles (1) is changed to 310 parts, the amount of the isocyanate-modified polyester prepolymer (1) is changed to 37 parts, and the amount of the ketimine compound (1) is changed to 2.3 parts.

A brilliant toner (5) is obtained in the same manner as in the preparation of the brilliant toner (1) except that the toner particles (5) are used.

Example 6

Oil Phase Liquid (1): 347 Parts

The above-described component is put into a vessel and stirred for 2 minutes with a homogenizer (Ultra Turrax, manufactured by IKA Japan K.K.) and thus an oil phase liquid (1P) is obtained. Then, 1180 parts of the water phase liquid (1) are added into the vessel and stirred for 20 minutes with a homogenizer. Next, the mixed solution is stirred for 48 hours at room temperature (25° C.) and normal pressure (1 atmosphere) with a propeller-type stirrer, and the organic solvent is removed to form a particulate material. Next, the particulate material is washed with water, dried and classified to obtain toner particles (6). The volume average particle diameter of the toner particles is 12 μm.

A brilliant toner (6) is obtained in the same manner as in the preparation of the brilliant toner (1) except that the toner particles (6) are used.

Comparative Example 1

Toner particles (C1) are obtained in the same manner as in the preparation of the toner particles (1) except that the amount of the oil phase liquid (1) in the preparation of the toner particles (1) is changed to 290 parts, the amount of the isocyanate-modified polyester prepolymer (1) is changed to 57 parts, and the amount of the ketimine compound (1) is changed to 3.8 parts.

A brilliant toner (C1) is obtained in the same manner as in the preparation of the brilliant toner (1) except that the toner particles (C1) are used.

Comparative Example 2

Toner particles (C2) are obtained in the same manner as in the preparation of the toner particles (1) except that the amount of the oil phase liquid (1) in the preparation of the toner particles (1) is changed to 316 parts, the amount of the isocyanate-modified polyester prepolymer (1) is changed to 31 parts, and the amount of the ketimine compound (1) is changed to 0.7 parts.

A brilliant toner (C2) is obtained in the same manner as in the preparation of the brilliant toner (1) except that the toner particles (C2) are used.

Comparative Example 3

Toner particles (C3) are obtained in the same manner as in the preparation of the toner particles (1) except that the amount of the oil phase liquid (1) in the preparation of the toner particles (1) is changed to 286 parts, the amount of the isocyanate-modified polyester prepolymer (1) is changed to 72 parts, and the amount of the ketimine compound (1) is changed to 1.1 parts.

A brilliant toner (C3) is obtained in the same manner as in the preparation of the brilliant toner (1) except that the toner particles (C3) are used.

Comparative Example 4

Toner particles (C4) are obtained in the same manner as in the preparation of the toner particles (1) except that the amount of the oil phase liquid (1) in the preparation of the toner particles (1) is changed to 304 parts, the amount of the isocyanate-modified polyester prepolymer (1) is changed to 33 parts, and the amount of the ketimine compound (1) is changed to 2.3 parts.

A brilliant toner (C4) is obtained in the same manner as in the preparation of the brilliant toner (1) except that the toner particles (C4) are used.

Measurement and Evaluation

Measurement of Molecular Weight

The Mz, Mn, and Mp of the binder resin of each of the brilliant toners obtained in the respective examples and comparative examples are measured by the aforementioned method. The results are shown in Table 1.

Preparation of Metallic Developer 36 parts of each of the brilliant toners obtained in the respective examples and 414 parts of a carrier are put into a 2 L V blender and stirred for 20 minutes, and the resultant is then sieved with a sieve having an opening of 212 μm to prepare each metallic developer. As the carrier, a carrier obtained in the following manner is used.

Preparation of Carrier

Ferrite particles (volume average particle diameter: 35 μm): 100 parts

Toluene: 14 parts

Methyl methacrylate-perfluorooctyl ethyl acrylate copolymer (critical surface tension: 24 dyn/cm): 1.6 parts Carbon black (trade name: VXC-72, manufactured by Cabot Corporation, volume resistivity: 100 Ωcm or less): 0.12 parts Cross-linked melamine resin particles (average particle diameter: 0.3 μm, insoluble in toluene): 0.3 parts First, the carbon black is diluted with the toluene and added to the methyl methacrylate-perfluorooctyl ethyl acrylate copolymer, followed by dispersion with a sand mill. Next, in the resultant, the above components other than the ferrite particles are dispersed with a stirrer for 10 minutes. Thus, a coating layer forming solution is prepared. Next, the coating layer forming solution and the ferrite particles are put into a vacuum degassing kneader, followed by stirring at a temperature of 60° C. for 30 minutes. Then, the pressure is reduced and the toluene is removed by distillation to form a resin coating layer. Thus, a carrier is obtained.

Evaluation

A developer unit of "modified machine of color 800 press" manufactured by Fuji Xerox Co., Ltd. is filled with the obtained metallic developer.

Using the modified machine, an image having an image density of 5% is output on 100,000 sheets of OK Topcoat paper (paper weight: 127, manufactured by Oji Paper Co., Ltd.) at a fixing temperature of 190° C. with a load of 4.0 kg/cm$^2$ at the time of fixing in a low temperature and low humidity condition of a temperature of 10° C. and humidity of 15% and then a band-shaped solid image with an image density of 100% and an amount of the brilliant toner applied of 4.5 g/m$^2$ is output on 3 sheets of OK Topcoat paper (paper weight: 127, manufactured by Oji Paper Co., Ltd.) at a fixing temperature of 190° C. with a load of 4.0 kg/cm$^2$ at the time of fixing in a high temperature and high humidity condition of a temperature of 28° C. and a humidity of 85%.

Brilliance: Measurement of Ratio (X/Y)

The solid image output on the third sheet is irradiated with incident light at an incident angle of −45° with respect to the solid image using a spectro-goniophotometer GC 5000 L (manufactured by Nippon Denshoku Industries Co., Ltd.) as a goniophotometer, and a reflectance X at a light-receiving angle of +30° and a reflectance Y at a light-receiving angle of −30° are measured. In addition, the reflectances X and Y are respectively obtained by performing measurement with light in a wavelength range of 400 nm to 700 nm at intervals of 20 nm and calculating the average value of reflectances of the respective wavelengths. The ratio (X/Y) is calculated from the measurement results. The results are shown in Table 1.

As the ratio (X/Y) becomes higher, the brilliance becomes higher. As the ratio (X/Y) becomes lower, the dull effect becomes stronger and the brilliance is less likely to be exhibited.

Observation of Toner Scattering (Fogging) to Non-Image Portion

In the solid image output on the third sheet, fogging in the boundary portion of the image (the boundary portion between the image portion and the non-image portion on the upstream side and the downstream side in the transporting direction) (toner scattering from the image portion to the non-image portion) is visually observed and evaluation is performed based on the following evaluation criteria. The results are shown in Table 1.

A: Fogging is observed on neither the upstream side nor the downstream side.

B: Slight fogging is observed on the upstream side but is not observed on the downstream side.

C: Fogging is observed on both the upstream side and the downstream side but is in an allowable range.

D: Fogging is beyond the allowable range.

TABLE 1

| | Toner | Mz | Mn | Mz/Mn | Mp | Ratio (X/Y) (Brilliance) | Fogging |
|---|---|---|---|---|---|---|---|
| Example 1 | (1) | 32,500 | 3,500 | 9.3 | 6,400 | 9.7 | A |
| Example 2 | (2) | 39,700 | 2,000 | 19.9 | 6,200 | 9.4 | B |
| Example 3 | (3) | 25,700 | 4,800 | 5.4 | 6,200 | 9.2 | B |
| Example 4 | (4) | 37,100 | 3,500 | 10.6 | 9,700 | 7.9 | B |
| Example 5 | (5) | 25,550 | 2,700 | 9.5 | 3,100 | 8.7 | B |
| Example 6 | (6) | 34,000 | 3,600 | 9.5 | 9,200 | 7.5 | C |
| Comparative Example 1 | (C1) | 41,000 | 2,000 | 20.5 | 4,270 | 6.9 | D |
| Comparative Example 2 | (C2) | 24,300 | 5,000 | 4.9 | 4,430 | 7.1 | D |
| Comparative Example 3 | (C3) | 36,000 | 3,200 | 11.3 | 10,200 | 6.4 | D |
| Comparative Example 4 | (C4) | 27,000 | 2,680 | 10.1 | 2,700 | 6.3 | D |

From the above results, it is found that in Examples, compared to Comparative Examples, even when an image having a low image density is continuously formed in a low temperature and low humidity environment and then an image having a high image density is formed in a high temperature and high humidity environment, an image in which high image brilliance is attained and a phenomenon that toner scatters from an image portion to a non-image portion (fogging) is prevented may be obtained.

Particularly, it is found that with the brilliant toners of Examples 1 to 5 having the toner particles including a urea-modified polyester resin, compared to the brilliant toner of Example 6 having toner particles not including a urea-modified polyester resin, even when an image having a low image density is continuously formed in a low temperature and low humidity environment and then an image having a high image density is formed in a high temperature and high humidity environment, an image in which high image brilliance is attained and a phenomenon that toner scatters from an image portion to a non-image portion (fogging) is prevented may be obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

toner particles that include:

a binder resin having a ratio (Mz/Mn) of a Z average molecular weight (Mz) to a number average molecular weight (Mn) of 5 to 20 and a peak top molecular weight (Mp) of 3,000 to 10,000, and a flake-shaped brilliant pigment, wherein the binder resin is a urea-modified polyester resin.

2. The brilliant toner according to claim 1, wherein the toner particles are obtained through preparing an oil phase liquid, which is a mixed solution obtained by mixing an organic solvent for dissolving the binder resin, the binder resin, and the brilliant pigment, preparing a suspension obtained by dispersing the oil phase liquid in an aqueous medium, and removing the organic solvent from the suspension.

3. The brilliant toner according to claim 1, further comprising:

aluminum as the brilliant pigment.

4. The brilliant toner according to claim 1, wherein the brilliant pigment has an aspect ratio of 5 to 200.

5. The brilliant toner according to claim 1, wherein a ratio (C/D) of an average maximum thickness C to an average equivalent circle diameter D of the toner particles is from 0.001 to 0.500.

6. The brilliant toner according to claim 1, wherein the ratio of the brilliant pigment in which an angle formed by a long axis direction of the toner particle in the cross section and a long axis direction of the brilliant pigment with respect to the total brilliant pigment is in a range of −30° to +30° is 60% or more.

7. An electrostatic charge image developer comprising:

the brilliant toner according to claim 1.

8. A toner cartridge that contains the brilliant toner according to claim 1 and is detachable from an image forming apparatus.

* * * * *